US010500612B2

(12) United States Patent
Berdelle-Hilge

(10) Patent No.: US 10,500,612 B2
(45) Date of Patent: Dec. 10, 2019

(54) MULTI-STAGE SORTING PROCESS WITH BATCH SEQUENCING

(71) Applicant: SIEMENS AKTIENGESELLSCHAFT, Munich (DE)

(72) Inventor: Peter Berdelle-Hilge, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/901,158

(22) Filed: Feb. 21, 2018

(65) Prior Publication Data

US 2018/0243799 A1 Aug. 30, 2018

Related U.S. Application Data

(60) Provisional application No. 62/461,453, filed on Feb. 21, 2017.

(51) Int. Cl.
*B07C 3/00* (2006.01)
*B07C 3/02* (2006.01)

(52) U.S. Cl.
CPC ..... *B07C 3/008* (2013.01); *B07C 3/02* (2013.01)

(58) Field of Classification Search
CPC ..... B07C 3/00; B07C 3/02; B07C 3/008
USPC ..... 209/629
See application file for complete search history.

(56) References Cited

U.S. PATENT DOCUMENTS

2006/0122858 A1* 6/2006 Miles ..... G06Q 10/00 705/28
2011/0046775 A1* 2/2011 Bailey ..... B07C 3/00 700/224

* cited by examiner

*Primary Examiner* — Terrell H Matthews
(74) *Attorney, Agent, or Firm* — Laurence Greenberg; Werner Stemer; Ralph Locher

(57) ABSTRACT

In a multi-stage sorting method, before a first sorting pass, containers can be placed with unsorted items in storage points of an empty store. Storage areas are determined for each pass. The areas are arranged orthogonal to one another. The containers are arbitrarily distributed within an area. In each sorting pass, one container from each area is retrieved as part of a batch group. The retrieval sequence is arbitrary in the first pass, and uses a sorting algorithm in subsequent passes. The degree of sorting of the mail items in the containers is increased in a sorting operation, storing positions are empty points generated by the retrieval or storage points with empty containers corresponding to a retrieval position, and the storing sequence is on a process-contingent random basis corresponding to an emptying of sorting end points. These process steps are repeated for as many batches as necessary to process a total volume of items.

6 Claims, 6 Drawing Sheets

- line oriented across the staging farm, i.e. in direction of the staging sections arrangement:

(shown here for BG 1 from left to right)

- area orientated, i.e. randomly distributed over the staging farm:

(shown here for BG 1)

The allocation of the sequenced batches of a batch group (here BG 1) to the staging sections can be

- line oriented across the staging farm, i.e. in direction of the staging sections arrangement (here from right to left):

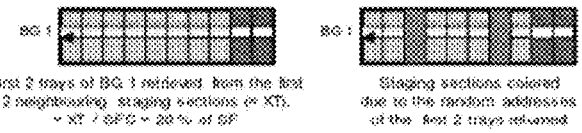

FIG. 6A

- area orientated, i.e. randomly distributed over the staging farm:

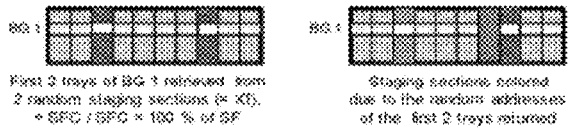

FIG. 6B

Rectangles,
Grey, light+dark: Staging farm with SFC neighbouring staging sections
dark: Staging sections, from which trays are retrieved
White: Empty cells or cells w/ empty trays, after the first two trays of a batch group are retrieved and reloaded

MULTI-STAGE SORTING PROCESS WITH BATCH SEQUENCING

CROSS-REFERENCE TO RELATED APPLICATION

This application claims the priority, under 35 U.S.C. § 119(e), of provisional patent application No. 62/461,453 filed Feb. 21, 2017; the prior application is herewith incorporated by reference in its entirety.

BACKGROUND OF THE INVENTION

Field of the Invention

The present invention relates to a method for using a container store in multi-stage sorting processes. In particular, the present invention relates to the use of a sorting method having a plurality of sorting passes, which requires an intermediate storage of the items for sorting during and between the sorting passes in containers provided.

In a container store required for this purpose, retrieval and storage operations are simultaneously necessary in any case in the sorting passes after the first sorting pass. If the storage positions or areas in the store are predetermined in the last sorting pass, storages are generally necessary at places from which the full containers have not yet been retrieved from the preceding sorting pass.

The problem/conflict has been avoided in principle by using a generally equal-sized store, such that items are alternately retrieved from one store and stored into the other store from sorting pass to sorting pass. Thus, however, the space requirement of the storage facility is doubled, as is the case, for example, in the Open Mail Handling System OMS.

The problem/conflict has also been avoided in principle by using intermediate storage places of relatively large number for short-term storage, from which items are restored therein after freeing the designated storage place. On account of the correspondingly additional rearrangement effort, increased demands are placed on the generally automatic handling apparatus.

Both disadvantages are effectively minimized by the method according to the invention.

SUMMARY OF THE INVENTION

It is therefore the object of the present invention to solve the problems known in the prior art. In particular, it is an object of the present invention to specify a method for efficient and dependable storage for multi-stage sorting processes.

These objects are achieved by a method in accordance with the features of the claims. The invention utilizes a sorting method having a plurality of sorting passes which requires an intermediate storage of the items for sorting during and between the sorting passes in containers provided, and where the store is recirculated in itself in the individual sorting passes. Further advantageous embodiments of the invention are indicated in the respective dependent claims. It should be noted that the features presented individually in the dependent claims can be combined in any technologically meaningful way and define additional embodiments of the invention.

Moreover the features indicated in the claims are specified and explained in greater detail in the description, wherein further preferred embodiments of the invention are described.

In particular, the objects are achieved according to the invention by a method of container store in multi-stage sorting processes. The multi-stage sorting process comprising:

- providing a multitude of storage containers, a container store, and a multitude of storage points at said container store;
- before a first sorting pass, placing storage containers with unsorted sorting items in any desired storage points of an empty store;
- determining storage areas for each sorting pass according to location and size, the storage areas having their arrangement directions orthogonal to one another;
- arbitrarily distributing the containers within a storage area;
- in each sorting pass, retrieving one container from each storage area as part of a batch group, where retrieving positions are either randomly distributed over all storage areas or sequentially along the arrangement direction of the storage areas, with a retrieval sequence being arbitrary in a first sorting pass, and being conditioned by a sorting algorithm in subsequent sorting passes;
- increasing a degree of sorting of the containers with sorting items in a sorting operation, where sorting positions are empty points generated by the retrieval or storage points with empty containers corresponding to one of the retrieval positions, and the storing sequence is on a process-contingent random basis corresponding to an emptying of sorting end points; and
- repeating a sorting pass for as many batch groups as are required for the processing of a total volume of sorting items.

In accordance with an added feature of the invention, the sorting items are items of mail.

In accordance with an additional feature of the invention, the items of mail are sorted at the sorting endpoints for mail delivery In accordance with a further feature of the invention, the items of mail are sorted at the sorting endpoints for an individual mail carrier delivery route sequence.

A significant reduction in the space requirement of the storage facility is achieved. Additionally, less demand and more efficient operation of the handling equipments is achieved by the method of the present invention. By determining the storage areas for each sorting pass according to location and size, with their arrangement directions being intended to be "orthogonal" to one another. The basis is the required storage end state after the last sorting pass. In the postal field, the storage regions contain, after the last sorting pass, generally in each case the volume of a postal delivery setup or parts thereof.

Other features which are considered as characteristic for the invention are set forth in the appended claims.

Although the invention is illustrated and described herein as embodied in the method of a container store in multi-stage sorting processes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 6A shows the allocation of the batches of a batch group to the storage regions; and FIG. 6B shows the allocation of the batches of a batch group to the storage regions.

DETAILED DESCRIPTION OF THE INVENTION

Figure 1A:
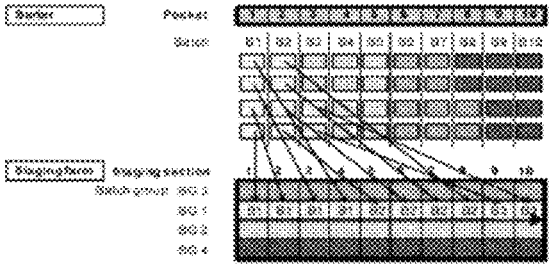
FIG. 1A shows an allocation of the sequenced batches of the batch groups to the staging sections.
Figure 1B:
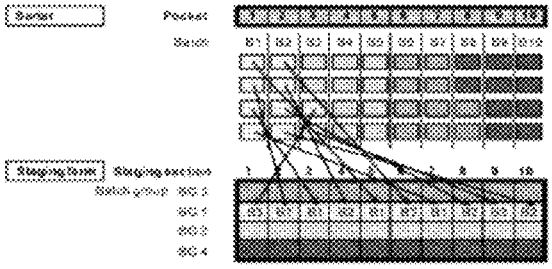
FIG. 1B shows an allocation of the sequenced batches of the batch groups to the staging sections.

FIGS. 1A and 1B show in general, the method of the invention where the use of one and the same store is achieved over all sorting passes. In other words, the store is re-circulated in itself in the individual sorting passes. FIG. 1A shows the allocation of the sequenced batches of the batch groups to the staging sections in the previous pass where the lines are oriented across the staging farm, i.e. in the direction of the staging sections arrangement. FIG. 1B shows the allocation of the sequenced batches of the batch groups to the staging sections in the previous pass being area oriented, i.e. randomly distributed over the staging farm. The allocation of the sequenced batches of the batch-groups to the staging sections in the previous pass can be line oriented across the staging farm or area oriented.

The figures show an embodiment where, by way of example, this operation is for all four containers of the 10 batches, with four batch groups being formed (each box representing one container).

The retrieval of containers produces empty points or storage points with empty containers in precisely the determined storage areas which are required for the storing of the containers (with mail now having an increased degree of sorting). In this case, a storage region takes up the volume of a sorting end point in the last sorting pass, i.e. the volume of a delivery setup or of a sub-region thereof.

A prerequisite for this is that, in the preceding first sorting pass, the batches are stored in sequence into the storage regions, with a storage region generally receiving one container. A batch is designated as the sum of all containers from a sorting end point in the preceding sorting pass, and a batch group is designated as the sum of all batches whose containers are required for the single occupancy of all storage regions with generally one container.

The containers of a batch group can be distributed singularly either in their sequence in the arrangement direction of the storage regions in the considered sorting pass over all the latter or randomly over the entire storage region. This is possible since the local distribution of the batches in the store does not have to correspond to their sorting-contingent sequence. This operation is then repeated as often as needed until the entire sorted volume of items has been stored.

The starting point of the sorting is thus the determination of the individual container storage regions before the start of the process, as required after completion of the sorting, that is to say after the last sorting pass. These are necessary in the postal field for example when the store consists of mobile storage units which are transported away after completion of the sorting and are assigned to certain mail carriers (Open Mail Handling System, OMS or Advanced Letter Processing System, ALPS of the USPS). The determination thereof will generally take place on the basis of historical data.

The sequence of the destination addresses of the containers to be stored into the specified storage regions in the last sorting pass is randomly corresponding to the time when sorting end points become full. Accordingly, the first container to be stored should already be able to be stored into each storage region.

The compliance with this requirement is made fully possible only through the sorting-contingent time delay between retrieval and storage of the first containers. This occurs because the content of the retrieved containers is generally sorted onto all sorting end points through the subsequent sorting pass. Thus, depending on the volume allocation to the sorting end points, a corresponding number of containers are required and thus empty points or storage points with empty containers are produced before sorting end points are filled for the first time and are emptied into containers which then have to be stored into the store.

If, in this "start period," between the start of the sorting pass and the arrival of the first container to be stored, the number of the retrieved containers or the container number of the first batch group corresponds to the number of the storage regions, and a container has been retrieved from each of these, it is possible, as required, that the first container to be stored can already be stored into each desired storage region after the emptying of the first sorting end point which has become full.

If the number of the containers retrieved in the "start period" or the container number of the first batch group is greater than the number of the storage regions, it is advantageously possible for correspondingly more containers to be retrieved per storage region until the first container has to be stored.

If, by contrast, the number of the containers retrieved in the "start period" or the container number of the first batch group is less than the number of the storage regions, it is possible that the storage region assigned to the first container to be stored still does not have an empty point or a storage point with an empty container.

In this case or when this situation generally occurs, a short-term intermediate storage of the container in storage points provided for this purpose is necessary.

In the further course of the sorting pass, after the "start period", the described procedure is repeated in principle, as in containers are successively retrieved from each storage region for each batch group to be retrieved. Here, too, the optimal number of the retrieved containers per storage region can be not equal to one in dependence on the respective process status.

In principle, this procedure described here for the last sorting pass also corresponds to the preceding sorting passes.

Figure 2:
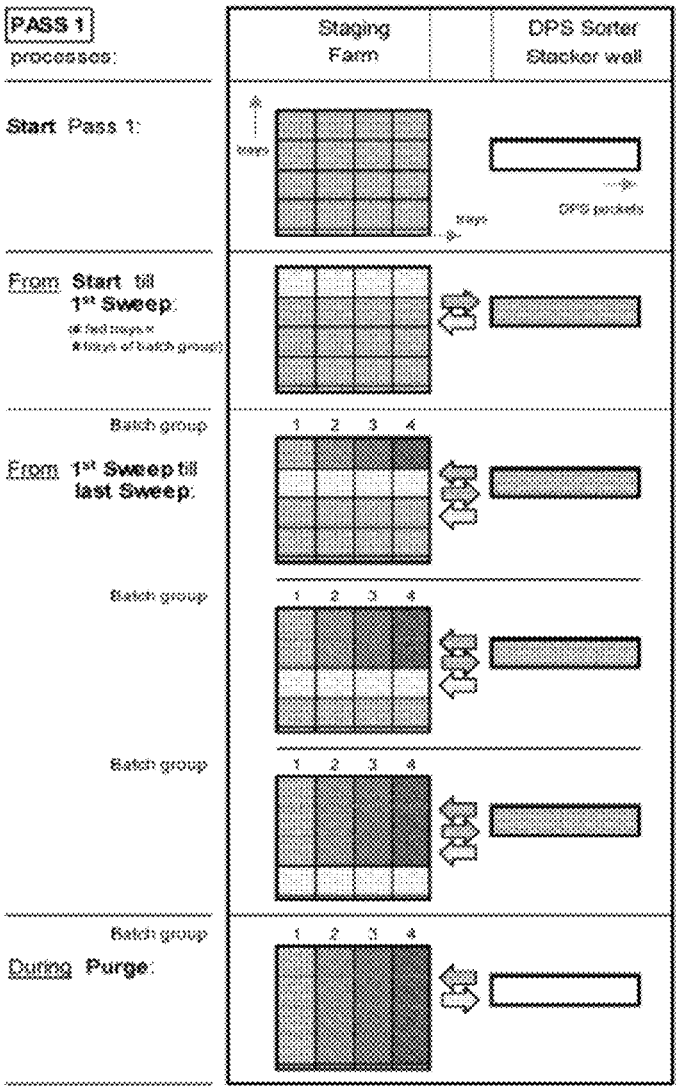
FIG. 2 shows material flow of the mail volumes between sorting system and store in the first sorting pass.
Figure 3:
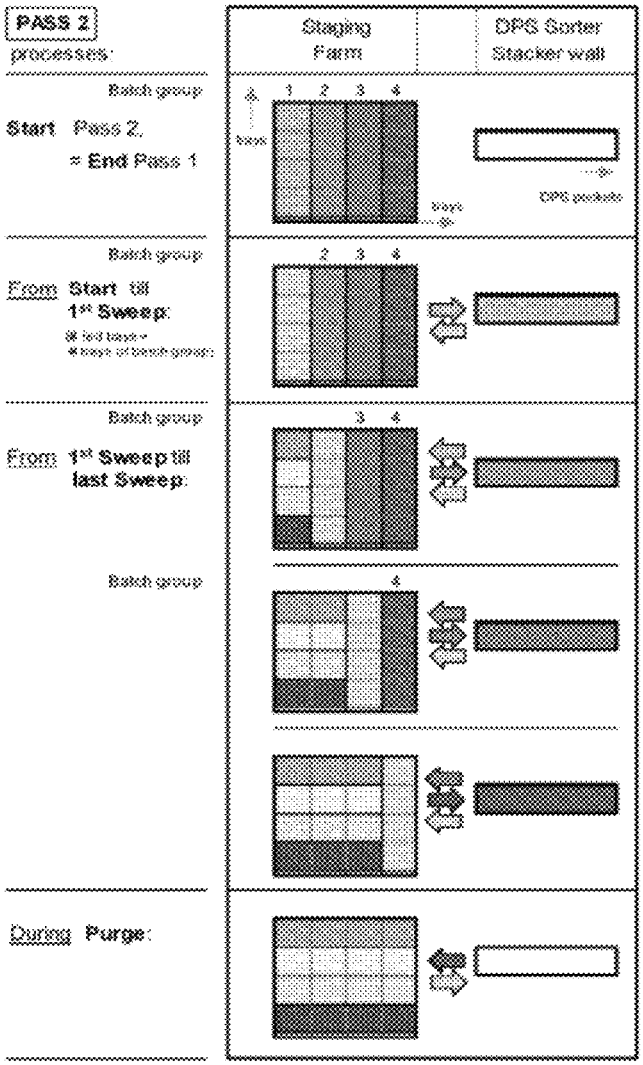
FIG. 3 shows material flow between sorting system and store in a second sorting pass.
Figure 5:
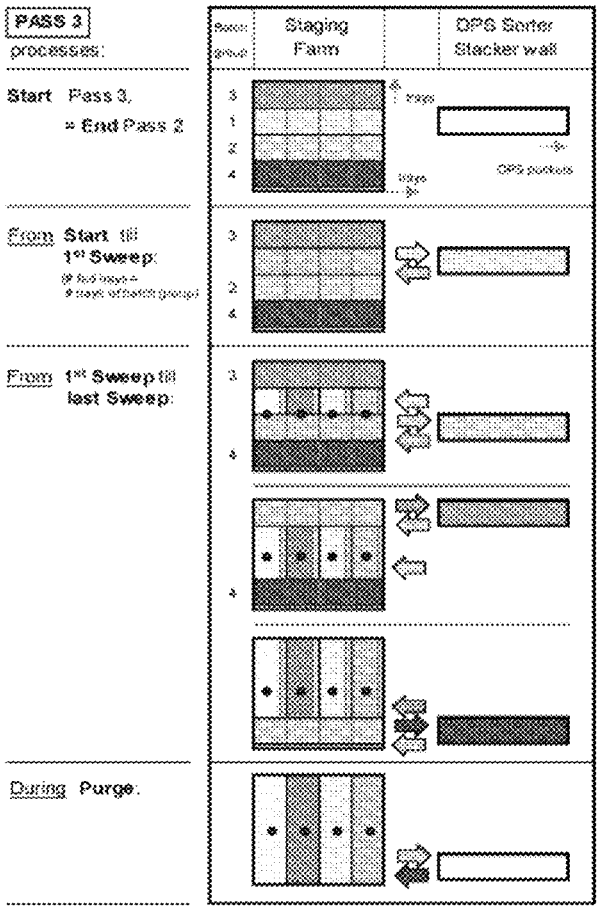
FIG. 5 shows a material flow between sorting system and store in a third sorting pass.

FIGS. 2, 3, and 5 show material flow of the mail volumes between sorting system and store in a first, second, and third sorting pass respectively. A process sequence according to a first exemplary embodiment of the invention is where before the first sorting pass the entire containers are sorted with unsorted sorting items in any desired storage points of the empty store. The storage areas are determined for each sorting pass according to location and size, their arrangement directions being intended to be orthogonal to one another. The basis is the required storage end state after the last sorting pass. In the postal field, the storage regions contain, after the last sorting pass, generally in each case the volume of a postal delivery setup or parts thereof. It is assumed that the distribution of the containers within a storage region can be arbitrary since any required sequence can be produced when unloading the mobile storage units at their destination location.

In each of the sorting passes, generally, one container from each storage region is retrieved as part of a batch group. The retrieval positions, described in more detail later, can either be advantageously randomly distributed over all storage regions, or sequentially along the arrangement direction of the storage regions. The retrieval sequence can be arbitrary in the first sorting pass on account of the unsorted state of the volume of items and is conditioned by the sorting algorithm, in subsequent sorting passes.

Containers are stored with items with a degree of sorting which is increased by the sorting operation. The storing positions are empty points generated by the retrieval or storage points with empty containers corresponding to one of the two above-described schemes for the retrieval positions. The storing sequence is on a process-contingent random basis corresponding to the emptying of sorting end points. The last two steps are repeated for as many batch groups as are required for the processing of the total volume of items in the considered sorting pass.

For an arrangement sequence of the batch groups in the storage regions, the position of the, generally one container per batch, group within a storage region can be the subject of an optimization in the last sorting pass. The criterion is the creation of as many as possible empty points or storage points with empty containers in the store directly after the completion of the pure sorting pass, before the final emptying of the sorting end points (purge) begins.

This produces the greatest possible degree of freedom in terms of the displacement of storage region limits. This is necessary when the size, which is determined before the beginning of the process, of storage regions is exceeded and fallen below in the sorting and the overall volume remains substantially unchanged at the same time.

Figure 4:
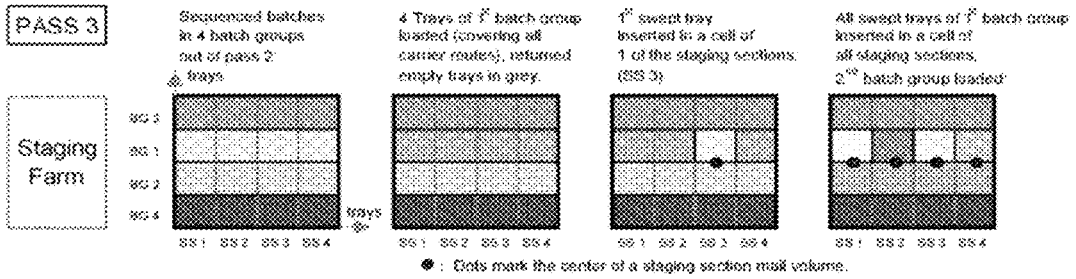
FIG. 4 shows a retrieval and storage of the first batch group from and into the store in a third sorting pass.

FIG. 4 shows such a maximization of empty points or storage points with empty containers arises when, corresponding to the batch group sequence, the containers thereof are each arranged toward the outside in both directions from the volume centroid of a storage region.

FIGS. 6A and 6B show the allocation of the batches of a batch group to the storage regions. The sequence determined in terms of sorting for the containers of a batch group which are to be retrieved does not also have to correspond to the local arrangement sequence offered since it can be produced during the retrieval itself.

Accordingly, these two fundamental possibilities are delimited with respect to one another below and differ from one another in terms of the retrieval complexity on account of relatively large travel distances and the possibility of an equally correct storage possibility for the returning containers.

FIG. 6A shows that the allocation of the sequenced batches of a batch group BG1 to the staging sections are line oriented across the staging farm, as in the direction of the staging sections arrangement. The first two trays of BG 1 are retrieved from the first two neighboring staging sections (=XT), which represents XT/SFC=20% of the staging form SF. The probability of matching staging sections with empty cells or cells with empty trays (due to retrieved trays) with random addresses of returning trays are calculated with $(XT/SFC)*(XT/SFC)=(XT/SFC)^2$.

FIG. 6B shows the allocation of the sequence batches of a batch group BG1 to the staging section are area oriented, as in randomly distributed over the staging farm. The first two trays of BG1 are retrieved from two random staging sections (=XT), which represents SFC/SFC=100% of the staging form SF. The probability of matching staging sections with empty cells or cells with empty trays (due to retrieved trays) with random addresses of returning trays are calculated with XT/SFC*1=XT/SFC. Therefore, the area oriented allocation of the batches within a batch group is to be preferred.

The invention claimed is:

1. A multi-stage sorting process, the method comprising:

providing a multitude of storage containers, a container store for temporarily storing the storage containers, and a multitude of storage positions for a placement of respective storage containers at said container store;

before a first sorting pass, placing storage containers with unsorted sorting items in any desired storage positions of an empty store;

determining storage areas for each sorting pass according to location and size, the storage areas generally having their arrangement directions orthogonal to one another;

arbitrarily distributing the containers within a storage area;

sorting the sorting items in a plurality of sorting passes and, in each sorting pass, retrieving generally one container from each storage area as part of a batch group, where retrieving positions are either randomly distributed over all storage areas or sequentially along the arrangement direction of the storage areas, with a retrieval sequence which can be arbitrary in a first sorting pass, and which is conditioned by a sorting algorithm in subsequent sorting passes;

storing the containers with an increased degree of sorting of the sorting items in the containers after each sorting pass, where storing positions are empty positions generated by the retrieval or storage positions with empty containers corresponding to one of the retrieval positions, and a storing sequence is on a process-contingent random basis corresponding to an emptying of sorting end points; and repeating the retrieving and storing of container steps for as many batch groups as are required for the processing of a total volume of sorting items in the respective sorting pass.

2. The multi-stage sorting process according to claim 1, wherein the sorting items are items of mail.

3. The multi-stage sorting process according to claim 2, wherein the items of mail are sorted at the sorting endpoints for mail delivery.

4. The multi-stage sorting process according to claim 2, wherein the items of mail are sorted at the sorting endpoints for an individual mail carrier delivery route sequence.

5. The multi-stage sorting process according to claim 1, wherein before the final emptying of the sorting end positions, creating as many empty positions or storage positions with empty containers as possible in the store in order to optimize the last sorting pass.

6. The multi-stage sorting process according to claim 1, wherein the sorting sequence for the containers of a batch group which are to be retrieved does not also have to correspond to the local arrangement sequence offered.

* * * * *